US005376493A

United States Patent [19]

Kobayashi

[11] Patent Number: 5,376,493

[45] Date of Patent: Dec. 27, 1994

[54] PROCESS FOR PRODUCING TONER

[75] Inventor: Hiroyuki Kobayashi, Kanagawa, Japan

[73] Assignee: Canon Kabushiki Kaisha, Tokyo, Japan

[21] Appl. No.: 701,113

[22] Filed: May 16, 1991

[30] Foreign Application Priority Data

May 17, 1990 [JP] Japan ..... 2-125537
May 17, 1990 [JP] Japan ..... 2-125538

[51] Int. Cl.[5] ..... G03G 9/08
[52] U.S. Cl. ..... 430/137
[58] Field of Search ..... 430/106, 137

[56] References Cited

U.S. PATENT DOCUMENTS 4,622,281 11/1986 Imai et al. ..... 430/107
4,810,612 3/1989 Ueda et al. ..... 430/110
4,837,100 6/1989 Murofushi et al. ..... 430/107
4,837,101 6/1989 Gruber et al. ..... 430/109
4,957,841 9/1990 Macholdt et al. ..... 430/110

FOREIGN PATENT DOCUMENTS 402882 12/1990 European Pat. Off. .
412494 2/1991 European Pat. Off. .
61-091666 5/1986 Japan .
61-117565 6/1986 Japan .
61-156054 7/1986 Japan .
62-30259 2/1987 Japan .

OTHER PUBLICATIONS

Patent Abstract of Japan, vol. 11, No. 335 (P-632) [2782] Nov. 4, 1987 based on JPA 62-119549.

*Primary Examiner*—John Goodrow
*Attorney, Agent, or Firm*—Fitzpatrick, Cella, Harper & Scinto

[57] ABSTRACT

A toner producing process comprises the steps of: mixing a solvent, a first binding resin soluble therein, and particles of a coloring agent insoluble therein, with each other, dispersing the particles of the coloring agent in the binding resin while applying a shearing force thereto to obtain a dispersed substance, removing the solvent from the dispersed substance to obtain a coloring agent-binding resin composition in which the particles of the coloring agent are dispersed, mixing the coloring agent-binding resin composition with a second binding resin and a charge controlling agent, melt-kneading the mixture to obtain a kneaded substance and forming toner from the kneaded substance.

18 Claims, 2 Drawing Sheets

PROCESS FOR PRODUCING TONER

BACKGROUND OF THE INVENTION

1. Field of the Invention

The present invention relates to a process for producing toner and, in particular, to a process for producing a toner which has a high level of staining power, brightness, and saturation, and which excels in charging stability.

2. Description of the Related Art

Generally, when manufacturing toner by grinding, a melt-kneaded intermediate mixture is formed. The melt-kneaded mixture is composed of: a binding resin such as a styrene-type resin, a styrene-acrylic-type resin, an epoxy resin, or a polyester resin; a coloring agent; an offset prevention agent; a charge controlling agent, etc. Afterwards, the melt-kneaded mixture is cooled, ground, and classified into the desired toner particles.

Melt-kneading is generally conducted by using a kneader such as a screw-type extruder, a pressure/heat kneader, a two-roll mill, a three-roll mill, or a Banbury mixer to obtain a melt-kneaded material out of the above melt-kneaded mixture through a single dispersion process. In a color toner for electrophotography, this melt-kneading process is a significant stage in the toner manufacture, since the nature of the dispersion among the toner particles of the coloring agent, the charge controlling agent, etc. depends on the melt-kneading process.

An uneven dispersion of the coloring agent contained in the binding resin results, in the case of color toner, in a reduced level of staining power and saturation and the color tone being rather pale. Furthermore, if the coloring agent undergoes a secondary agglomeration and becomes segregated in the binding resin, an unevenness in density will result.

Moreover, a defective dispersion among the toner particles of the charge control agent may, in some cases, cause a defect in the charging property, which is fatal to any toner for use in electrophotography. For example, there can occur a delay in the triboelectric charging of the toner, resulting in a reduced level of triboelectric charging. In addition, such a defective dispersion will cause the triboelectric charging property of the toner to vary to an excessive degree, e.g., between low-temperature/low-humidity and high-temperature/high-humidity conditions.

If copying is repeated to make a large number of photocopies, the triboelectric charging properties of the toner deteriorates. The toner is then likely to exhibit a broad triboelectric charge distribution, which means it has become rather poor in its environmental stability.

There have been proposed a number of methods for solving the problem of defective dispersion of the coloring agent and/or the charge controlling agent in the toner. According to one of these methods, the melt-kneaded material is passed through a kneading machine a plurality of times in order to improve the dispersion. With this method, however, a degree of dispersibility beyond the inherent dispersion equilibrium of the kneading machine cannot be obtained. Accordingly, it is difficult to obtain the expected result even if the kneaded material is passed through the kneading machine a plurality of times. In another method, a preparatory mixing machine such as a flow mixer, a Henschel mixer, a micro-speed mixer, or a flash mixer, is used. With this method, however, the dispersion is, in most cases, effected by means of mixing blades, which are rotated at high speed, causing the temperature in the container to rise during mixing, and the binding resin to adhere to the blades or to the inner container walls, and/or to melt and stick to the main shaft section.

Still another method is the master batch method, according to which a resin composition containing a coloring agent of high density is prepared beforehand. The resin composition is then diluted by the same binding resin to obtain a desired kneaded material. For example, Japanese Patent Application Laid-Open No. 62-30259 discloses a method according to which a finely ground master batch is melted and diluted. A problem with this method is that the fine-grinding process must be repeated a plurality of times before a desired toner can be obtained, so that there is an enormous consumption of energy and at an unduly high cost. Further, this method gives no consideration to the dispersibility of the charge controlling agent, which greatly influences the triboelectric charging characteristic of the toner.

Japanese Patent Application Laid-Open No. 61-117565 and 61-91666 disclose toner producing processes according to which the binding resin and the coloring agent are dispersed in a solvent, which is then removed, thereby obtaining toner. These methods are improved as compared to a simple melt-kneading method in terms of the evenness in the dispersion of the coloring agent. However, since the granulation is effected in water, the toner particles are liable to contain water, or the particle surfaces are subject to hydration, so that a satisfactory triboelectric charging characteristic is hard to obtain, a condition which is not favorable to electrophotography.

Japanese Patent Application Laid-Open No. 61-117565 and 61-156054 disclose methods according to which the binding resin and the charge controlling agent are previously dissolved and dispersed in a solvent, and, after removing the solvent, the dispersed composition is melt-kneaded together with the binding resin and the coloring agent. The present inventors examined these methods and found them very satisfactory in regard to dispersion, but rather undesirable in terms of triboelectric charging characteristic of toner. For example, when mixing the toner with a carrier, the triboelectric charging ability of toner remained at a low level, and the amount of the charge obtained through temporary friction with the carrier inside the electrophotographic developing apparatus tended to gradually decrease. The present inventors presume this phenomenon is attributable to the fact that the effective amount of charge controlling agent existing on the toner surface decreases due to the excessively good dispersion of the charge controlling agent, preventing the toner and the carrier from being charged to a satisfactory degree. Electrostatically, it is said that charging caused by mutual friction between material surfaces involves at most only that portion of the material to the depth of several thousand Angstroms from material surface. In view of this, it is to be assumed that that portion of the charge controlling agent in the center of the toner particle, or that deeper than several Å from the toner particle surface, has substantially nothing to do with the triboelectric charging.

SUMMARY OF THE INVENTION

The present invention provides a toner producing process in which the above problems have been eliminated.

An object of this invention is to provide a toner producing process in which the coloring agent can be dispersed in a satisfactory manner, making it possible to obtain a toner having a high level of staining power.

Another object of this invention is to provide a toner producing process which forms a color toner having a high level of saturation and which excels in transparency.

Still another object of this invention is to provide a toner producing process for obtaining a toner excelling in triboelectric charging stability.

A further object of this invention is to provide a toner producing process which promotes the production of a toner image having a high level of image density.

A still further object of this invention is to provide a toner producing process for obtaining a color toner which does not easily deteriorate after copying a large number of times.

A still further object of this invention is to provide a toner producing process which helps to obtain a toner excelling in environmental stability.

In accordance with this invention, there is provided a process for producing toner, comprising the steps of:

forming a mixture of a solvent, a first binding resin soluble in said solvent, and particles of a coloring agent insoluble in said solvent;

dispersing the particles of the coloring agent in the binding resin while applying to said mixture a shearing force to obtain a dispersed substance;

removing the solvent from the dispersed substance to obtain a coloring agent-binding resin composition in which the particles of the coloring agent are dispersed in said binding resin;

admixing the coloring agent-binding resin composition with a second binding resin and a charge controlling agent and melt-kneading the resulting mixture to obtain a kneaded substance; and forming toner from the kneaded substance.

The charge controlling agent is present in effective amounts adjacent the surface of the toner particles.

DETAILED DESCRIPTION OF THE INVENTION

Figure 1:
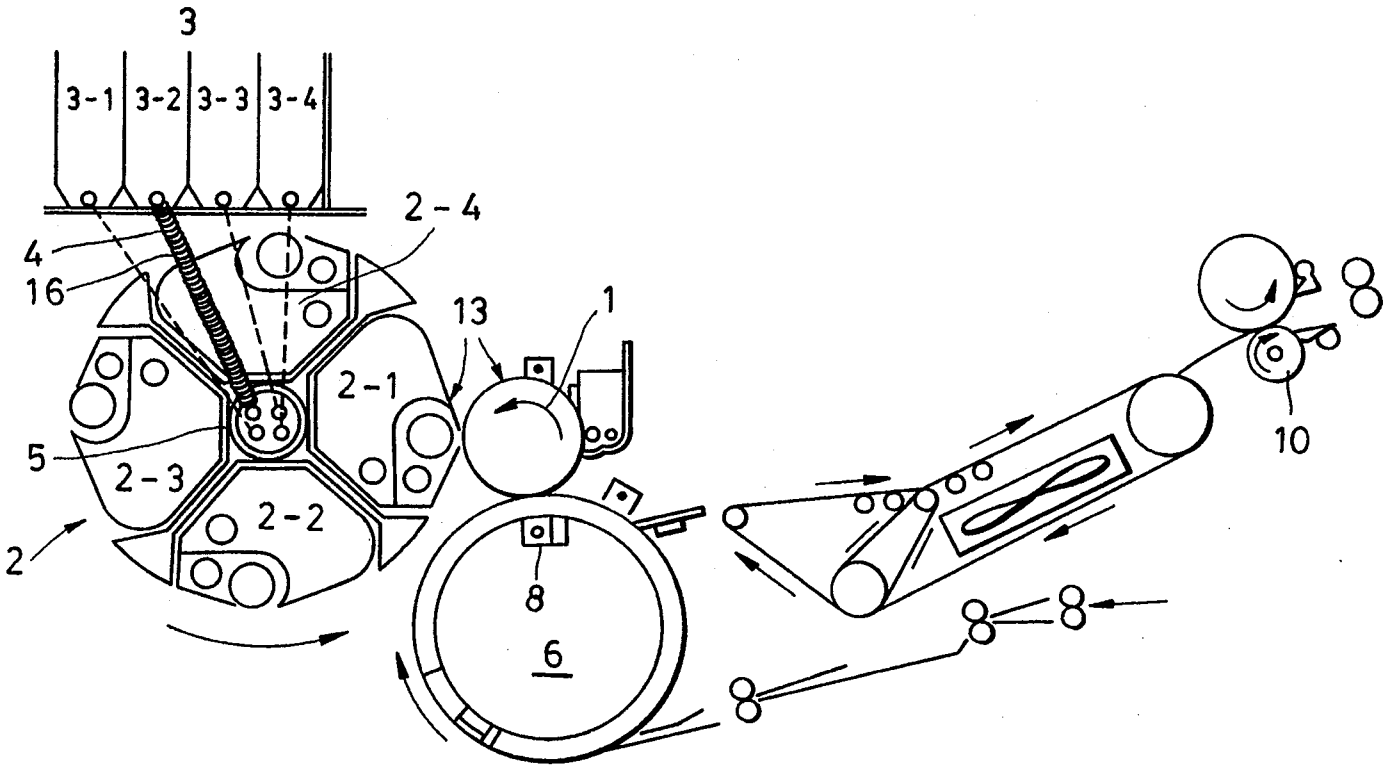
FIG. 1 is a schematic diagram showing a multi-color electrophotographic apparatus having an opc photosensitive drum.

In the toner producing process of this invention, a solvent is mixed with a first binding resin soluble therein and a coloring agent insoluble therein so as to dissolve the first binding resin and as to suspend the coloring agent in the solvent. Further, the particles of the insoluble coloring agent are dispersed in the solvent while applying a shearing force thereto, and then the solvent is removed from the mixture, thereby obtaining a resin composition. Added to this resin composition are a second binding resin and a charge controlling agent. The mixture thus obtained is melt-kneaded, with toner being formed from the kneaded substance thereby obtained.

A first feature of this invention consists in the suspension of the coloring agent in a solvent in which the binding resin is soluble so as to enhance the dispersion of the coloring agent in the binding resin, with the coloring agent particles being dispersed in the binding resin while positively applying a shearing force thereto. The reason for employing a coloring agent insoluble in the solvent is that the toner particles obtained are far better in terms of light stability when the coloring agent existing among the toner particles is in a granular form than when it is in a molecular form.

A color toner obtained by this method of dispersing coloring agent excels in terms of brightness, saturation, and image density.

A second feature of this invention is the selective dispersion of the charge controlling agent onto the toner particle surfaces. To attain a satisfactory dispersibility of the coloring agent, it is desirable that the kneading process be continued until a dispersion equilibrium is attained. As for the dispersion of the charge controlling agent, it is not enough to simply disperse it in the binding resin uniformly when a toner having a desirable triboelectric charging characteristic is to be obtained. It is assumed that a toner particle can be triboelectrically charged in a desirable manner only when its surface comes into contact with some other object, from which it receives a charge. Accordingly, it is the characteristics, composition, configuration, etc. of the surface of the toner particle that greatly contribute to the triboelectric charging characteristics of the toner. In any event, it is difficult to comprehend that the composition of the toner portion deeper than several thousand Å (Angstroms) from the toner particle surface would influence the triboelectric charging of the toner. Thus, it may be assumed that, if a certain amount of charge controlling agent is dispersed to a sufficient degree, a substantially uniform distribution of the charge controlling agent can be seen inside the toner particle and on the surface thereof. Accordingly, the effective amount of charge controlling agent on the toner particle surface must inevitably decrease due to the fact that it is divided between the interior and the surface of the particle.

In the present invention, the charge controlling agent is dispersed separately from the dispersion of the coloring agent, which is insoluble in the solvent, so that most of the charge controlling agent may exist on the toner particle surface, though some of the charge controlling agent exists inside the toner particle. This arrangement helps to improve the triboelectric charging of the toner, thereby making it possible to attain a speedy rise in toner charging, a uniformity in charging, etc.

Accordingly, an effective amount of charge controlling agent is present adjacent the surface of the toner particles. As employed herein the term "adjacent" means either at the surface of the toner particles or within a few thousand angstroms of the surface.

Generally, toner particles having a grain size ranging from several to several tens of μm are obtained through the kneading and grinding processes. The material interface in grinding is said to be easier to grind between homogeneous material pieces than heterogeneous ones. In this invention, grinding is easier between the charge controlling agent and the binding resin, which, to some extent, exist in the form of particles. Thus, it may be assumed that a relatively large amount of charge controlling agent tends to exist on the individual toner particle surfaces, exerting a favorable influence on the triboelectric charging characteristic of the toner.

At the same time, the coloring agent, insoluble in the solvent, is wet-dispersed in the binding resin under the presence of the solvent, thereby making it possible to obtain a satisfactory level of staining power and light stability. Furthermore, due to the existence of a large amount of charge controlling agent in the vicinity of the particles of the coloring agent on the toner particle surface, a desired triboelectric charging polarity and charging amount can be attained even when a coloring agent whose polarity is reverse to that of the toner is used. In contrast, using an unaccompanied coloring agent of reverse polarity will result in a low charging amount which is short of a desired level or generation of a large number of toner particles which are so badly controlled as to cause fogging.

Examples of the conventional solvents used in this invention typically include: methanol, ethanol, propanol, formaldehyde, acetaldehyde, methyl ethyl ketone, benzene, toluene, xylene, chlorobenzene, dichlorobenzene, nitrobenzene, and tetrahydrofuran and the like.

Examples of the first binding resin soluble in the above solvents include: styrene-type resins (monopolymers and copolymers including styrene and substitution products of styrene), such as polystyrene, chloropolystyrene, poly-α-methylstyrene, styrene-chlorostyrene copolymer, styrene-propylene copolymer, styrene-butadiene copolymer, styrene-vinyl-chloride copolymer, styrene-vinyl acetate copolymer, styrene-maleic acid copolymer, a styrene-acrylic ester copolymer (styrene-methyl acrylate copolymer, styrene-ethyl acrylate copolymer, styrene-butyl acrylate copolymer, styrene-octyl acrylate copolymer, styrene-phenyl acrylate copolymer, etc.), a styrene-methacrylate copolymer (styrene-methyl methacrylate copolymer, styrene-ethyl methacrylate copolymer, styrene-butyl-methacrylate copolymer, styrene-phenyl-methacrylate copolymer, etc.), styrene-α-chloro-methyl-acrylate copolymer, or styrene-acrylonitrile-acrylic-ester copolymer; rosin-denatured maleic resins; phenol resins; epoxy resins; polyester resins; low molecular weight polyethylene, low molecular weight polypropylene; ionomer resins; silicone resins; ketone resins; ethylene-ethylacrylate copolymers; xylene resins; and polyvinylbutyral resins. Examples of especially desirable binding resins for the toner of this invention include styrene-acrylic-ester-type resins, styrene-methacrylic ester-type resins, and polyester resins.

Particularly, a polyester resin obtained at least through co-condensation polymerization of a bisphenol derivative or a substitution product thereof which can be typically expressed by the following formula:

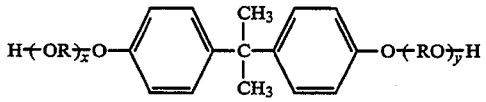

(where R indicates an ethylene or a propylene group, and x and y indicate positive integers of 1 or more, with the average value of x+y being in the range of 2 to 10.) as a diol component, and a carboxylic acid component comprising a carboxylic acid whose valence is two or more or an acid anhydride thereof or a lower alkylester thereof (e.g., fumaric acid, maleic acid, maleic anhydride, phthalic acid, terephthalic acid, trimellitic acid, pyromellitic acid, etc. ) is desirable since it exhibits a sharp melting characteristic.

It is necessary for the first binding resin to be soluble in the solvent used. Preferably, the solubility of the first binding resin should be such that about 5 g or more (more preferably, 10 g or more) thereof is soluble in 100 g of the solvent used at a temperature of 20° C.

The second binding resin may comprise a resin selected from among the ones given as examples with reference to the first binding resin. Preferably, the second binding resin should be the same kind of resin as the first binding resin.

It is desirable that about 10 to 100 parts by weight (more preferably, 20 to 60 parts by weight) of the solvent be used with respect to 100 parts by weight of the first binding resin. A solvent amount of less than about 10 parts by weight is too small and may result in an insufficient dispersion of the coloring agent particles in the first binding resin. On the other hand, a solvent amount of over about 100 parts by weight is too large and can result in the viscosity in the mixing system being rather low, with the agglomerates of coloring agent particles being hard to grind to a satisfactory degree by a shearing force.

The coloring agent insoluble in the solvent may be a pigment or a dye which is insoluble in the solvent. Examples of preferable pigments include: quinacridone-type pigments, diazo yellow pigments, insoluble azo pigments, and copper-phthalocyanine-type pigments.

The quinacridone-type pigments include those given in Table 1. Above all, C.I. Pigment Red 122 is especially excellent as a magenta-type coloring agent.

TABLE 1

| Color Index | Structural formula |
|---|---|
| (1) C.I. Pigment Red 202, 209 | 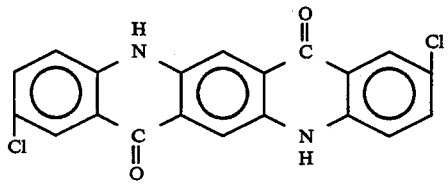 |
| (2) C.I. Pigment Red 206 | 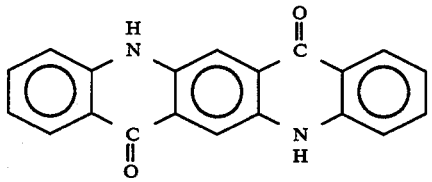 |
| | 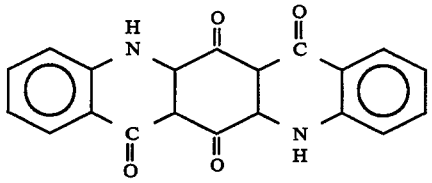 |
| (3) C.I. Pigment Red 207 | 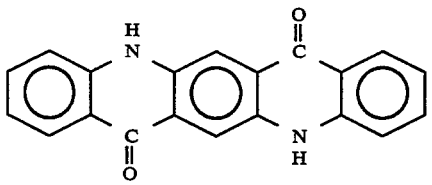 |

TABLE 1-continued

| Color Index | Structural formula |
|---|---|
| | 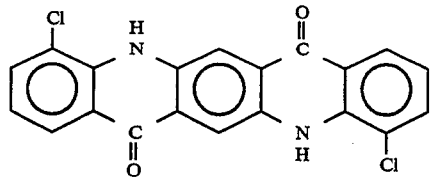 |
| (4) C.I. Pigment Violet 19 | 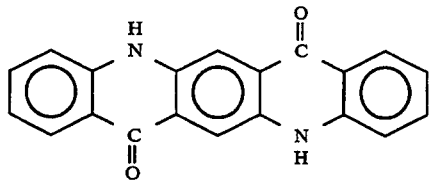 |
| (5) C.I. Pigment Red 122 | 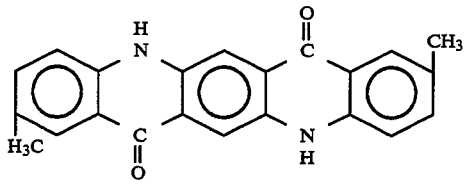 |

Examples of the phthalocyanine-type pigments include: a copper phthalocyanine pigment (C.I. Pigment Blue 15), a copper phthalocyanine-type pigment which is a Ba salt obtained through substitution of two or three carboxybenzamide methyl groups in a phthalocyanine skeleton and which can be expressed by one of the following structural formulae (I) or (II):

(I)

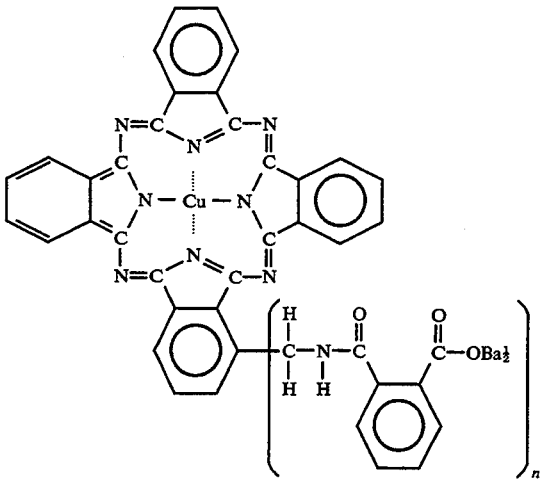

n = 2~3

-continued (II)

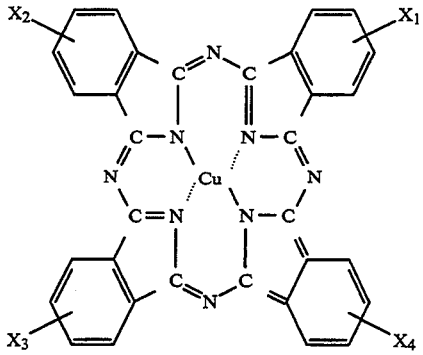

[where $X_1$ to $X_4$ indicate

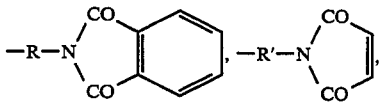

or H, and R and R′ indicate alkylene groups having a carbon number ranging from 1 to 5, with the cases where $X_1$ to $X_4$ are all —H being excluded.]

Other examples of the pigment include: Naphthol Yellow S, Hansa Yellow G, Permanent Yellow NCG, Permanent Orange GTR, Pyrazolone Orange, Benzidine Orange G, Permanent Red 4R, Watchung Red calcium salt, Brilliant Carmine 3B, Fast Violet B, Methyl Violet lake, Fast Sky Blue, and Indanthrene Blue BC.

To name them by Color Index number, examples of the pigment include: C.I.Pigment Yellow 17, C.I.Pigment Yellow 15, C.I.Pigment Yellow 13, C.I.Pigment Yellow 14, C.I.Pigment Yellow 12, C.I.Pigment Red 5, C.I.Pigment Red 3, C.I.Pigment Red 2, C.I.Pigment Red 6, C.I.Pigment Red 7, and C.I.Pigment Blue 16.

By the coloring agent being insoluble in the solvent is meant a coloring agent substantially insoluble in the solvent. Preferably, the solubility of the coloring agent which is insoluble in the solvent should be such that about 0.1 g or less (more preferably, 0.05 g or less) thereof is soluble in 100g of the solvent at a temperature of 20° C.

It is desirable that from about 1 to 200 parts by weight of the coloring agent insoluble in the solvent be used with respect to 100 parts by weight of the first binding resin soluble in the solvent. A coloring agent amount of less than about 1 part by weight will result in the staining power likely being rather poor. On the other hand, coloring agent amounts of over about 200 parts by weight may result in the coloring agent dispersion being defective.

In the process where the solvent, the binding resin soluble therein, and a mixture containing a coloring agent insoluble therein are mixed with each other, the mixture may contain a coloring agent which is soluble in the solvent. It is desirable that the amount of the coloring agent soluble in the solvent be less than that of the coloring agent insoluble therein. Preferably, from about 1 to 30 parts by weight (more preferably, 5 to 20 parts by weight) of the coloring agent soluble in the solvent should be used with respect to 100 parts by weight of the first binding resin.

The coloring agent soluble in the solvent used may be a dye or a pigment which is soluble in the solvent. A suitable dye may be a basic dye or an oil soluble dye.

Examples of the coloring agent soluble in the solvent include: C.I.Solvent Red 49, C.I.Solvent Red 52, C.I.-Solvent Red 109, C.I.Basic Red 12, C.I.Basic Red 1, C.I.Basic Red 3b, C.I.Direct Red 1, C.I.Direct Red 4, C.I.Acid Red 1, C.I.Basic Red 1, C.I.Mordant Red 30, C.I.Direct Blue 1, C.I.Direct Blue 2, C.I.Acid Blue 9, C.I.Acid Blue 15, C.I.Basic Blue 3, C.I.Basic Blue 5, and C.I.Mordant Blue 7.

It is desirable that the solubility of the coloring agent soluble in the solvent be such that about 10 g or more (more preferably, 50g or more) of it can be dissolved in 100g of the solvent at 20° C.

In the present invention, coloring agents which are rather poor in light stability, such as, C.I.Disperse Y164, C.I.Solvent Y77, and C.I.Solvent Y93, are not recommended.

In regard to yellow toner, which sensitively reflects the permeability of the OHP film, it is desirable that about 0.1 to 12 parts by weight, more preferably, 0.5 to 7 parts by weight, of the yellow coloring agent be used with respect to 100 parts by weight based on the total of the binding resins.

A yellow coloring agent amount of over 12 parts by weight tends to result in a rather poor reproducibility for green and red colors, which are colors mixed with yellow, and, for human flesh color in an image.

In regard to magenta and cyan toners, it is desirable that about 0.1 to 15 parts by weight, more preferably, 0.1 to 9 parts by weight, of the magenta and cyan coloring agents be used with respect to 100 parts by weight in total of the binding resins.

It is desirable that the charge controlling agent used in this invention be colorless or light-colored so that it does not affect the tone of the color toner. Further, it is desirable that the addition of the charge controlling agent should cause the toner charging amount to be increased by 10% or more as compared to the case where it is not added.

The charge controlling agent may be a metal complex of an aromatic compound having a carboxyl or a hydroxyl group. A typical example of such a metal complex may be a metal complex of an alkyl-substituted salicylic acid. For example, a chromium complex of di-t-butyl salicylic acid, an aluminum complex of di-t-butyl salicylic acid, a zinc complex of di-t-butyl salicylic acid, and a copper complex of di-t-butyl salicylic acid, may be employed. Further, a chromium complex of di-t-butyl salicylic acid, a zinc complex of di-t-butyl salicylic acid, and an aluminum complex of di-t-butyl salicylic acid are preferable.

The amount of the charge controlling agent to be added may preferably be about 0.1 to 10 parts by weight, more preferably 0.5 to 8 parts by weight, with respect to 100 parts by weight in total of the binding resins.

In the manufacturing process of this invention, the solvent, the first binding resin soluble in the solvent, the coloring agent insoluble therein, and the coloring agent soluble therein as an arbitrary ingredient, are mixed with each other by a dispersion means having a shearing force. Examples of the dispersion means having a shearing force include dispersing machines such as a screw extruder, a pressure kneader, a Banbury mixer, a two-roll mill, a three-roll mill, and a ball mill. It is desirable that the dispersion be conducted under heating. Further, to suppress the evaporation of the solvent used in the dispersion process, the dispersion of the coloring agent should preferably be performed with heating condition and/or in a closed system. The heating temperature preferably ranges from about 50° to 100° C., and the dispersion time from about 0.1 to 10 hours (more preferably, from 0.5 to 5 hours).

Further, a combined use of different dispersion means in the dispersion process is desirable for improving the dispersion of the coloring agent insoluble in the solvent. For example, the following combinations may be possible: a pressure kneader and a two-roll mill; a pressure kneader and a three-roll mill; a two-roll mill and a screw extruder; a combination of a ball mill, a pressure kneader, a screw extruder, etc.

After the dispersing step, the solvent is removed from the dispersion substance, thereby forming a colored resin composition in which the coloring agent, insoluble in the solvent, is dispersed.

It is desirable that the coloring resin composition be pulverized, for it can then be easily mixed with the second binding resin and the charge controlling agent.

It is desirable that the second binding resin be the same kind as the first one. Preferably, from about 50 to 2000 parts by weight (more preferably, 100 to 1000 pares by weight) of the second binding resin is used with respect to 100 parts by weight of the first binding resin.

The amount of the charge controlling agent used should preferably be from about 0.1 to 10 parts by weight (more preferably, 0.5 to 8 parts by weight) with respect to 100 parts by weight based on the total of the first and second binding resins.

The coloring resin composition, the second binding resin, and the charge controlling agent are melt-kneaded by a melt-kneading machine, such as a kneader, an extruder, or a roll mill.

After roughly grinding by means of a grinder, such as a cutter mill or a hammer mill, the kneaded substance is then finely ground by means of a fine grinder, such as a jet mill.

The finely ground substance is classified by means of a classifying machine, such as a zigzag classifier and/or an elbow jet classifier, thereby obtaining a toner.

Figure 2:
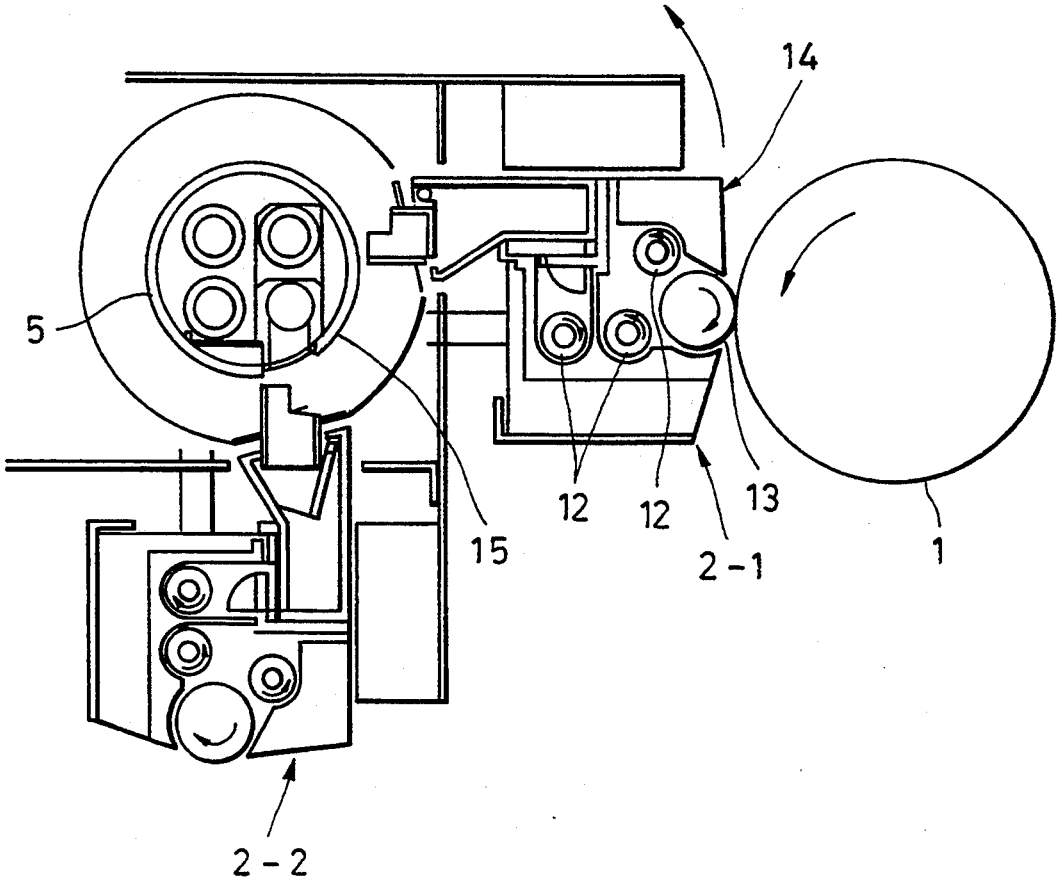
FIG. 2 is a schematic enlarged view of the toner-supply/development system of the multi-color electrophotographic apparatus shown in FIG. 1.

The toner obtained by the method of this invention is mixed with a carrier, and can be used for toner image formation in a multi-color electrophotographic apparatus having an OPC photosensitive drum and a supply/-development system as shown in FIGS. 1 and 2.

Referring to FIGS. 1 and 2, the supply toner fed by a supply screw 16 provided in a toner feeding cable 4 is connected at a toner supply port 15 to a developing device 2—2 (see FIG. 2), and supplied into the developing device.

When the developing device has reached through rotation a position where it faces the photosensitive drum 1, the supply toner is uniformly mixed with a developer in a very short time by mixing/feeding screws 12 and becomes a developer of a fixed developer concentration.

A predetermined amount of the developer is taken on the developing sleeve 13 by a developer control blade 14, with negatively charged toner being transferred, at a position facing the photosensitive drum 1, to the photosensitive drum 1, which has a negatively charged latent image, by the reversible development method.

The present invention will now be described in detail with reference to specific examples.

EXAMPLE 1

A magenta toner was prepared from the following materials:

70 parts by weight of a polyester resin obtained through condensation of propoxy-bisphenol and fumaric acid (which has a weight average molecular weight of 18,000 and a solubility of more than 10 g with respect to 100 g of methyl ethyl ketone);

30 parts by weight of a quinacridone pigment (C.I. Pigment Red 122, which is substantially insoluble in methyl ethyl ketone); and 20 parts by weight of methyl ethyl ketone (b.p.: approx. 80° C.).

The ingredients were introduced into a pressure kneader having a closed-type container and equipped with two agitating blades for dispersing the coloring agent by a shearing force. The kneader was then operated slowly at room temperature until the resin and pigment were well mixed with the methyl ethyl ketone. Subsequently, the temperature in the closed container was gradually raised and the power output was increased in order to enhance the mixing capacity of the kneader with the temperature rise. The kneader agitation was continued for two hours at approximately 80° C. Then, the dispersed substance was taken out of the kneader and passed ten times through a two-roll mill at 60° C. Further, to completely remove the methyl ethyl ketone contained therein, the dispersed substance was dried for 12 hours by means of a hot-air dryer at 80° C. to obtain a resin composition of a magenta color.

The magenta-colored resin composition was ground by a speed mill into particles of a grain size of approximately 2 mm. Added to 100 parts by weight of the ground substance thus obtained were 530 parts by weight of the above polyester resin and 24 parts by weight of a pulverized chromium containing organic complex (a chromium complex of dialkyl salicylic acid), the mixture being melt-kneaded by means of a biaxial extruder. The final kneaded substance was ground and classified to obtain a magenta toner having a volume average grain size of 8 μm.

100 parts by weight of the magenta toner obtained was mixed with 0.4 parts by weight of hydrophobic colloidal silica, thereby preparing a magenta toner having hydrophobic colloidal silica on the toner particle surface.

This magenta toner was mixed with a ferrite carrier coated with a styrene-acrylic resin and having an average grain size of 45 μm, thereby preparing a starting agent (a two-component developer) having a toner concentration of 5 wt %.

In order to examine the characteristics of the toner thus obtained, a copying test was conducted by introducing the starting agent into a color electrophotographic apparatus having an OPC photosensitive drum.

The test was performed with a magenta toner alone under low-temperature/low-humidity and high-temperature/high-humidity conditions, performing copying 30,000 times while supplying the magenta toner. Even after copying 30,000 times, the photocopy exhibited no fogging, with the image thereon excelling in saturation and not differing from that of the photocopies obtained at the initial stage. No blurring or deterioration in density was involved during the continuous copying. The toner charging amount at the initial stage of the copying and that after copying 30,000 times were −38.5 μc/g and −40.2 μc/g, respectively.

EXAMPLE 2

A yellow toner was prepared in the same way as in Example 1, except for the fact that, instead of the maqenta pigment used therein, a yellow pigment (C.I. Pigment Yellow 17) substantially insoluble in methyl ethyl ketone was used, copying was conducted with a toner concentration of 4.0% and under low-temperature/humidity and high-temperature/humidity (30° C., 80% RH) conditions.

Even after copying 30,000 times, the image obtained was a satisfactory one, exhibiting no fogging or toner scattering.

EXAMPLE 3

A cyan-colored resin composition was obtained in the same way as in Example 1 by using a pressure kneader and a three-roll mill and the following materials:

60 parts by weight of a styrene-butyl acrylate copolymer (copolymer weight ratio=85:15; weight average molecular weight=40000; more than 10 g soluble in 100 g of xylene);

40 parts by weight of a cyan pigment (C.I.Pigment Blue 15, which is substantially insoluble in xylene); and 30 parts by weight of xylene.

Added to the cyan-colored resin composition thus obtained were 540 parts by weight of the above styrene-acrylic copolymer and 20 parts by weight of an aluminum complex of di-t-butyl salicylic acid (the charge controlling agent), and the mixture was kneaded by means of the three-roll mill. The kneaded substance was cooled, ground, and classified, thereby obtaining a cyan toner having a volume average grain size of 8.5 μm. 100 parts by weight of the cyan toner thus obtained was mixed with 0.4 parts by weight of a hydrophobic colloidal silica to prepare a cyan toner having hydrophobic colloidal silica on the toner particle surface.

Subsequently, the respective toner concentrations of the cyan, yellow and magenta toners of Examples 1, 2 and 3 were adjusted to 5%, 4%, and 5%, and full-color copying was performed 50,000 times under normal-temperature/humidity condition while supplying the respective toners.

The resulting photocopies were satisfactory ones, the images thereon exhibiting no fogging, blurring, or deterioration in density. The respective image densities and charging amounts of these toners after copying 50,000 times were as shown in Table 2.

TABLE 2

| | Initial stage | | After copying 50,000 times | |
|---|---|---|---|---|
| Toner | Image density | Charging amount | Image density | Charging amount |
| Yellow | 1.52 | −34.3 μc/g | 1.45 | −30.2 μc/g |
| Magenta | 1.58 | −36.8 μc/g | 1.60 | −31.4 μc/g |
| Cyan | 1.45 | −32.5 μc/g | 1.40 | −34.5 μc/g |

COMPARISON EXAMPLE 1

In the absence of solvent, a magenta resin composition was obtained by using a pressure kneader in the same way as in Example 1, except for the fact that the following materials were used:

70 parts by weight of the polyester resin of Example 1;

30 parts by weight of a quinacridone pigment; and 24 parts by weight of a chromium complex (the charge controlling agent).

Subsequently, 530 parts by weight of the above-mentioned polyester resin was added to the kneaded composition obtained, and a magenta toner was obtained by using a biaxial extruder.

A copying test conducted in the same manner as in Example 1 indicated a rather low image density at the initial stage, with the image density gradually deteriorating as the test went on. An initial image density of 1.0 (as measured by a Macbeth reflection densitometer using a green filter) was reduced, after copying approximately 10,000 times, to 0.60.

This is assumed to be attributable to a defective dispersion of the coloring agent and an inadequate toner charging control.

EXAMPLE 4

A magenta toner was prepared in the same way as in Example 1, except for the fact that, in the dispersion process, 6 parts by weight of a Rhodamine dye (C.I.Solvent Red 49), soluble in methyl ethyl ketone (300 g/100 g), was further added as a coloring agent. 100 parts by weight of the magenta toner obtained was mixed with 0.4 parts by weight of a hydrophobic colloidal silica to prepare a magenta toner having hydrophobic colloidal silica on the toner particle surface.

This magenta toner was mixed with a ferrite coated with a styrene-acrylic resin and having an average grain size of 45 μm, thereby preparing a starting agent having a toner concentration of 5%.

A copying test was conducted in the same manner as in Example 1. Copying was performed 40,000 times using the magenta toner alone and under a low-temperature/humidity condition while supplying the magenta toner. Even after copying 40,000 times, the image obtained was a phosphorescent magenta image excelling in saturation and brightness, which was not different from those obtained at the initial stage of the copying.

During the continuous copying, no increase in fogging or deterioration in image density was to be observed. The image density and charging amount at the initial stage of copying and those after copying 40,000 times were as shown in Table 3.

TABLE 3

| | Initial stage | After copying 40,000 times |
|---|---|---|
| Image density | 1.43 | 1.48 |
| Charging amount | −34.6 μc/g | −31.5 μc/g |

EXAMPLE 5

A yellow toner was prepared in the same way as in Example 4, except for the fact that, instead of the magenta pigment used there, yellow pigments (C.I.Pigment Yellow 17, insoluble in methyl ethyl ketone, and C.I.Solvent Yellow 14, soluble in methyl ethyl ketone) were used, with the respective final coloring agent concentrations being 4 wt % and 0.8 wt % and with repeating copying with a toner concentration of 4.5%.

The images obtained at the initial stage excelled in OHP transparency and had a high level of saturation, and those obtained after copying 30,000 times were also satisfactory, exhibiting no fogging or toner scattering.

EXAMPLE 6

A cyan-colored resin composition was obtained in the same way as in Example 4 by using a pressure kneader, a three-roll mill and the following materials:

60 parts by weight of a styrene-butyl acrylate copolymer (copolymer weight ratio=85:15; weight average molecular weight=40000; more than 10 g soluble in 100 g of toluene);

36 parts by weight of a phthalocyanine pigment (C.I.-Pigment Blue 15, which is substantially insoluble in toluene);

1.8 parts by weight of a phthalocyanine dye (C.I.Solvent Blue 55, which is soluble in toluene);

7.2 parts by weight of anthraquinone dye (C.I. Solvent Blue 35, which is soluble in toluene); and 25 parts by weight of toluene. Added to 105 parts by weight of the cyan-colored resin composition powder obtained were 540 parts by weight of the above styrene-acrylic copolymer and 20 parts by weight of an aluminum complex of di-t-butyl salicylic acid, and the mixture was kneaded by the three-roll mill. The kneaded substance was then ground and classified, to thereby obtain a cyan toner having a volume average grain size of 8.0 μm. 100 parts by weight of the cyan toner obtained was mixed with a hydrophobic colloidal silica, thereby preparing a cyan toner having hydrophobic colloidal silica on the toner particle surface.

Subsequently, the respective toner concentrations of the cyan, yellow and magenta toners of Examples 4, 5 and 6 were adjusted to 5% 4.5% and 5% and full-color copying was repeated 50,000 times by using a full color copying apparatus as shown in FIG. 1 under a condition of normal temperature and humidity while supplying the respective toners.

The resulting photocopies were satisfactory and the image thereon exhibiting no fogging, blurring, or deterioration in density.

COMPARISON EXAMPLE 2

A magenta toner was prepared in the same way as in Comparison Example 1 by using a Rhodamine dye alone. A light stability test of 60H exposure (using a fade meter manufactured by Suga Shikenki) showed that the magenta toner was excessively poor in terms of the initial image density retention ratio. Thus, it was not fit for practical use. Table 4 shows the results of the light stability test.

TABLE 4

| Toner | Exposure time (hour) 0 | 20 | 40 | 60 |
|---|---|---|---|---|
| Magenta toner of Example 4 | 100% | 97% | 96% | 96% |
| Quinacridone toner of Comp. Ex. 1 | 100% | 98% | 98% | 98% |
| Rhodamine toner of Com. Ex. 2 | 100% | 43% | 30% | 25% |

In the above light stability test, solid images were formed by using the specimen toners in such a manner that the respective image densities are substantially the same, and exposed by the fade meter. The images were extracted at predetermined points of time for image density measurement, judging light stability from the density retention rate as compared to the initial density given as 100%.

As described above, the toner producing process of this invention provides the following advantages:

(a) A toner can be obtained which, due to the good dispersion of the coloring agent, exhibits a high level of staining power and which excels in saturation and transparency;

(b) A toner can be obtained which does not involve deterioration in triboelctric charging even after repeated copying and whose charging characteristic excels in environmental stability; and (c) It helps to obtain a clear toner image having a high image density.

What is claimed is:

1. A process for producing toner comprising the steps of:

(a) forming a mixture of (i) 10 to 100 parts by weight of a solvent, (ii) 100 parts by weight of a first binding resin which is soluble in said solvent, and (iii) particles of a coloring agent which are insoluble in said solvent;

(b) dispersing the particles of said coloring agent in said binding resin while applying to said mixture a shearing force to obtain a dispersed substance;

(c) removing said solvent from said dispersed substance while applying shearing force to obtain a coloring agent-binding resin composition in which the particles of said coloring agent are dispersed in the binding resin;

(d) admixing said coloring agent-binding resin composition with a second binding resin and a charge controlling agent and melt-kneading the resulting mixture to obtain a kneaded substance; and (e) forming said toner from said kneaded substance.

2. A process according to claim 1, wherein the toner particles are prepared by cooling and then grinding said kneaded substance.

3. A process according to claim 1, wherein said second binding resin is the same as said first binding resin.

4. A process according to claim 1, wherein said dispersion substance further contains a coloring agent which is soluble in said solvent.

5. A process according to claim 1, including grinding said coloring agent-binding resin composition before mixing with said second binding resin and said charge controlling agent.

6. A process according claim 1, wherein from about 10 to 100 parts by weight of said solvent is used per 100 parts by weight of said first binding resin, and wherein from about 1 to 200 parts by weight of said coloring agent which is soluble in said solvent is used per 100 parts by weight of said first binding resin.

7. A process according to claim 1, wherein said dispersion substance contains, with respect to 100 parts by weight of said first binding resin, (i) from about 10 to 100 parts by weight of said solvent, (ii) from about 1 to 200 parts by weight of said coloring agent which is insoluble in said solvent, and (iii) from about 1 to 30 parts by weight of a coloring agent which is soluble in said solvent.

8. A process according to claim 1, wherein from about 50 to 2000 parts by weight of said second binding resin is used per 100 parts by weight of said first binding resin.

9. A process according to claim 1, wherein 0.1 to 10 parts by weight of said charge controlling agent is used with respect to 100 parts by weight in total of said first and second binding resins.

10. A process according to claim 1, wherein from about 0.5 to 8 parts by weight of said charge controlling agent is used with respect to 100 parts by weight based on the total of said first and second binding resins.

11. A process according to claim 1, including dispersing said solvent, said first binding resin which is soluble therein, and said coloring agent which is insoluble therein under heat and pressure.

12. A process according to claim 1, including dispersing said solvent, said first binding resin which is soluble therein, and said coloring agent which is insoluble therein at a temperature ranging from about 50° to 100° C.

13. A process according to claim 1, including said solvent, said first binding resin which is soluble therein, and said coloring agent which is insoluble therein in a closed container at a temperature ranging from about 50° to 100° C.

14. A process according to claim 1, wherein the solvent is an organic solvent selected from the group consisting of methanol, ethanol, propanol, formaldehyde, acetaldehyde, methyl ethyl ketone, benzene, toluene, xylene, chlorobenzene, dichlorobenzene, nitrobenzene and tetrahydrofuran.

15. A process according to claim 1, wherein the first binder resin is a resin selected from the group consisting of styrene-acrylic ester-type resins, styrene-methacrylic ester-type resins and polyester resins.

16. A process according to claim 1, wherein the first binder resin comprises a polyester resin obtained at least through co-condensation polymerization of (a) a diol component comprising a bisphenol derivative or a substitution product thereof which is shown by the following formula:

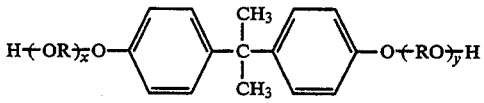

where R is an ethylene or a propylene group, and x and y are each positive integers of 1 or more, with the average value of (x+y) being in the range of 2 to 10; and (b) a carboxylic acid component comprising a carboxylic acid whose valence is two or more, an acid anhydride of said carboxylic acid or a lower alkyl ester of said carboxylic acid.

17. A process according to claim 16, wherein the carboxylic acid component is a compound selected from the group consisting of fumaric acid, maleic acid, maleic anhydride, phthalic acid, terephthalic acid, trimellitic acid and pyromellitic acid.

18. A process according to claim 1, wherein the first binding resin has a solubility of 5 g or more in 100 g of the solvent at a temperature of 20° C.

* * * * *

UNITED STATES PATENT AND TRADEMARK OFFICE

CERTIFICATE OF CORRECTION

PATENT NO. : 5,376,493

DATED : December 27, 1994

INVENTOR(S) : HIROYUKI KOBAYASHI

It is certified that error appears in the above-identified patent and that said Letters Patent is hereby corrected as shown below:

COLUMN 5

Line 47, "acrylic-" should read --acrylic--.

COLUMN 12

Line 5, "maqenta" should read --magenta--.

COLUMN 14

Line 17, "toluene. Added" should read --toluene. ¶ Added--.
Line 32, "full color" should read --full-color--.

COLUMN 15

Line 43, "according" should read --according to--.

UNITED STATES PATENT AND TRADEMARK OFFICE

CERTIFICATE OF CORRECTION

PATENT NO. : 5,376,493

DATED : December 27, 1994

INVENTOR(S) : HIROYUKI KOBAYASHI

It is certified that error appears in the above-identified patent and that said Letters Patent is hereby corrected as shown below:

COLUMN 16

Line 18, "including" should read --including dispersing--.

Signed and Sealed this

Sixth Day of June, 1995

Bruce Lehman

*Attest:*

BRUCE LEHMAN

*Attesting Officer*

*Commissioner of Patents and Trademarks*